United States Patent [19]

Griffin, Jr.

[11] 4,000,704

[45] Jan. 4, 1977

[54] SHIPPING PALLET

[75] Inventor: Charles E. Griffin, Jr., High Point, N.C.

[73] Assignee: Burlington Industries, Inc., Greensboro, N.C.

[22] Filed: Oct. 18, 1974

[21] Appl. No.: 516,202

[52] U.S. Cl. ..... 108/53.1; 108/53.3; 108/55.3; 108/901; 206/599; 206/511

[51] Int. Cl.[2] ..... B65D 19/38; B65D 21/02

[58] Field of Search ..... 108/51–58; 206/386, 503, 507, 509, 511, 512, 518; 214/10.5 R

[56] References Cited

UNITED STATES PATENTS

| | | | |
|---|---|---|---|
| 3,346,137 | 10/1967 | Ricci | 206/511 X |
| 3,371,816 | 3/1968 | Ricci | 206/511 X |
| 3,524,415 | 8/1970 | Heiman | 108/53 |
| 3,526,195 | 9/1970 | Maryonovich | 108/53 |
| 3,664,271 | 5/1972 | Wolder et al. | 108/51 |
| 3,667,403 | 6/1972 | Angelbeck, Jr. | 108/58 |
| 3,696,761 | 10/1972 | Brown | 108/53 |

*Primary Examiner*—Roy D. Frazier
*Assistant Examiner*—William E. Lyddane
*Attorney, Agent, or Firm*—Cushman, Darby & Cushman

[57] ABSTRACT

A shipping tray or pallet which can serve either as a top or bottom support tray for a shipping container that allows for nesting of one or more trays so that only a minimum amount of space is required when returning empty trays and an improved method for interlocking foot portions or legs of two stacked trays so that safer and more stable stacking is possible and lateral shifting of one tray with respect to another when in a stacked configuration is prohibited. Each of the foot portions of the trays is provided with male and female reinforcing ribs which will interlock with complementary legs on a similarly designed tray.

4 Claims, 17 Drawing Figures

SHIPPING PALLET

BACKGROUND OF THE INVENTION

This invention relates to a lightweight, resuable shipping pallet made of any moldable material and which, in addition to being nestable, provides improved stacking qualities.

In the past, the most common pallet was made of wood, but as discussed in many prior art patents, wooden pallets suffered many faults, not the least of which was the fact that wooden pallets are heavy, expensive to make and suffer from weather degradation. The pallets made from molded materials, such as thermoplastics, do not suffer from many such faults and numerous various designs and construction types have been patented.

A variety of methods of achieving great strength have been presented in prior art patents. Deluca U.S. Pat. No. 3,140,672 achieves its strength through a cross-ribbed network which interconnects legs while in Leitzel U.S. Pat. No. 3,187,691 a variety of oblique ribs are used to impart strength. In Toot U.S. Pat. No. 3,424,110 a series of ribs defining rectangles which are intersected by radial ribs are thought to provide support while in Lawlor U.S. Pat. No. 3,762,342 the strength has been found through co-equal, opposite and parallel top and bottom cavities, with the cavities on one side being equal in volumetric capacity of the cavities on the opposite side.

There have been many attempts to provide fully nestable trays. The term "nesting" refers to the ability of one pallet to be positioned on top of and within another so that the vertical components of the two pallets are such that the overall height is less than the sum of the height of the individual pallets. In Sullivan U.S. Pat. No. 3,199,468 nesting was achieved by having a plurality of circular frustum legs which fit into each other. In Heimman U.S. Pat. No. 3,524,415 nesting is achieved by having the hollow leg portions tapered so that legs of one tray telescope within the cavity defined by the legs of another tray. Likewise, in Maryonovich U.S. Pat. No. 3,526,195 legs are tapered to permit entry of a leg of an adjacent pallet for nesting purposes.

However, molded pallets are not without their problems. A major disadvantage of most plastic pallets is that they lack adequate stacking properties or, in order to achieve stackability, several different trays would have to be used. The term "stacking," as used in this application, refers to the placement of one shipping container on top of another shipping container so that the bottom pallet of the top container will rest on the upper pallet of the bottom container. Desirably, as little vertical space as possible should be used, the stack must be stable and lateral shifting of one container with respect to another must be prevented. Likewise, each pallet must be capable of supporting the loads placed upon it.

Prior art patents have considered several stacking approaches, but in applicant's opinion such approaches do not adequately solve stability, shifting and support problems. In Heimman U.S. Pat. No. 3,524,415, stacking is accomplished by using a bottom shipping tray of one design and a separate, differently designed, upper shipping lid. When the tray and lid are fastened together around a load, a shipping container is produced. Neither the tray nor the lid is disclosed as being interchangeably usable as either a top or a bottom member of a shipping container. Further, when another shipping is stacked on the top pallet, the weight of the upper container is not supported by reinforcing ribs or feet of the top pallet, but rather by the decking surface of the top pallet, which is a weaker area of support.

Stacking is also discussed in Maryonovich U.S. Pat. No. 3,526,195 and is accomplished by having the various legs, which are located or positioned asymmetrically with regard to the center line of the pallet, fit into sockets which are provided in the decking surface and immediately adjacent the upper portion of each of the legs. With the end of each leg fitting into such sockets, horizontal or lateral shifting of one pallet with respect to the other would be prevented but the supporting member of the stacked pallet has been shifted from the feet or legs to the decking area within each socket.

The supporting member of pallets is normally the foot or leg portion and, as such, each foot is required to have strength sufficient to support a given load. However, when stacking several shipping containers or loads, one on another, the shipping trays or pallets may well have to support the combined weight of several loads. When a pallet is used as a bottom tray for a shipping container, all of the weight of that shipping container, and any shipping containers stacked thereupon, should be borne by the feet of such pallet. Likewise, when the same pallet is inverted and used as the top tray for a shipping container, all of the weight of any shipping containers stacked thereupon should be borne by the feet of the pallet. In a pallet as described by the Maryonovich patent, for instance, the stacked support function shifts to the decking portion within each socket. The deck area forming the end of each socket has not been designed to act as a support member and at the time when the load factor increases, the weight shifts to an area least able to withstand such weight, the decking.

SUMMARY OF THE INVENTION

The pallet described herein may be formed from a single sheet of any formable material, such as any thermoplastic material, for instance, polyethylene or polypropylene, by conventional forming processes, such as, for example, thermoplastic vacuum forming. Such processes are well known and for purposes of this disclosure further elaboration is felt to be unnecessary.

The pallet with which this invention is concerned is generally rectangular in shape and has a primary surface or decking area which is generally planar for supporting the load and a reinforcing rib network which in part forms the main supporting feet for the pallet. The interior of the pallet is formed such that pallets can be nested together for shipping purposes. The unique foot portions of the pallet are designed so that they will positively interlock with complementary foot portions of other similarly designed pallets so as to positively prevent lateral shifting of one pallet with respect to one stacked thereon. At the same time the foot portions provide the support for the pallet in both a stacked and unstacked arrangement.

It is, therefore, the principle object of this invention to provide an improved stacking pallet structure which not only uses reinforcing members in the formation of the foot portions of the pallet, but also uses the reinforcing members in such a way that the thus-formed foot portions have an interlocking capability with the foot portions of stacked pallets. The foot portions are the main support members when the shipping container is resting on the floor and when the shipping container is in a stacked configuration.

A better understanding of the present invention will be gained by reference to the accompanying drawings and to the more detailed description that follows. In the drawings.

Figure 1:
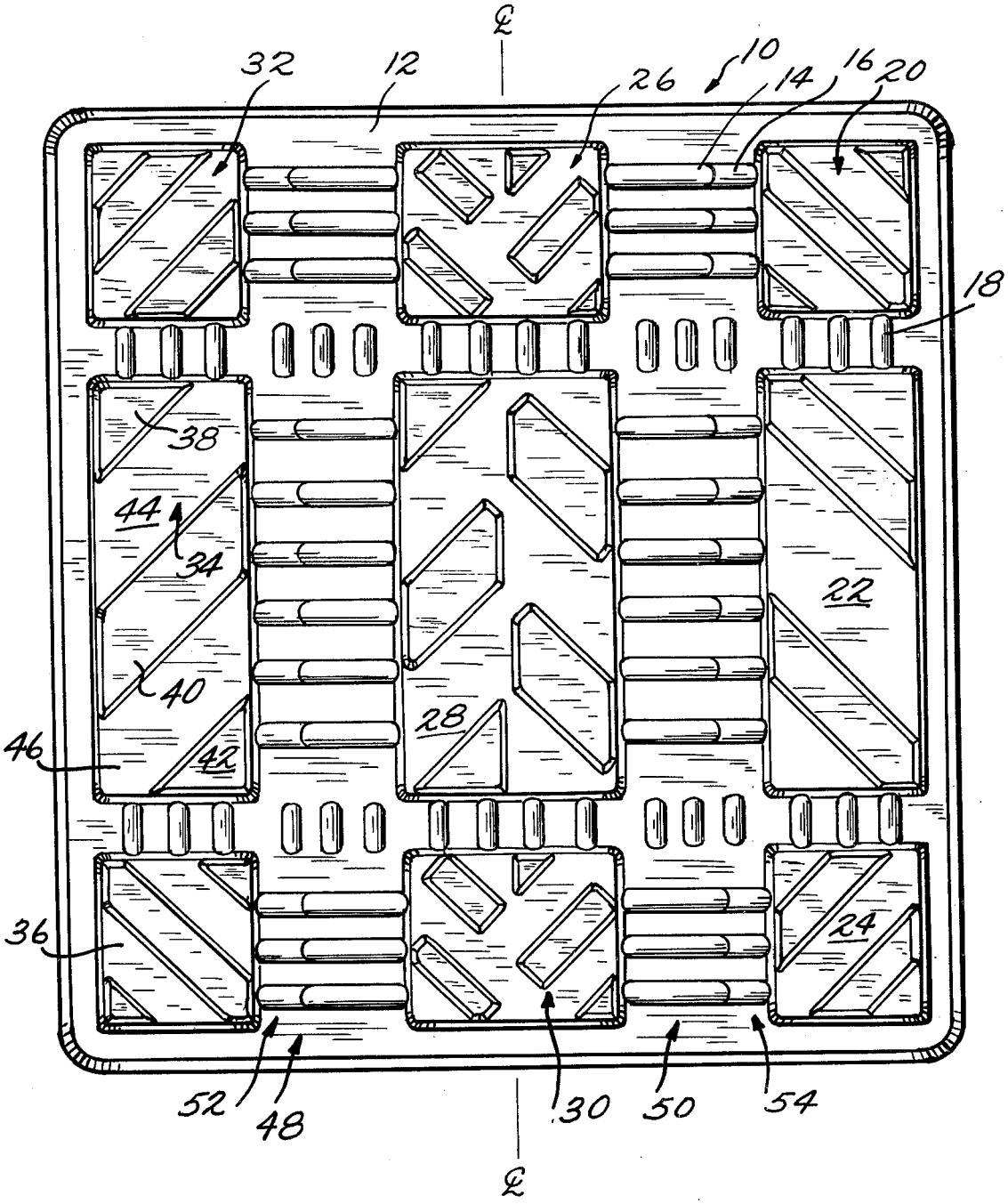
FIG. 1 is a view of the bottom or convex side of the pallet of the invention having two-way fork truck entry channels.
Figure 2:
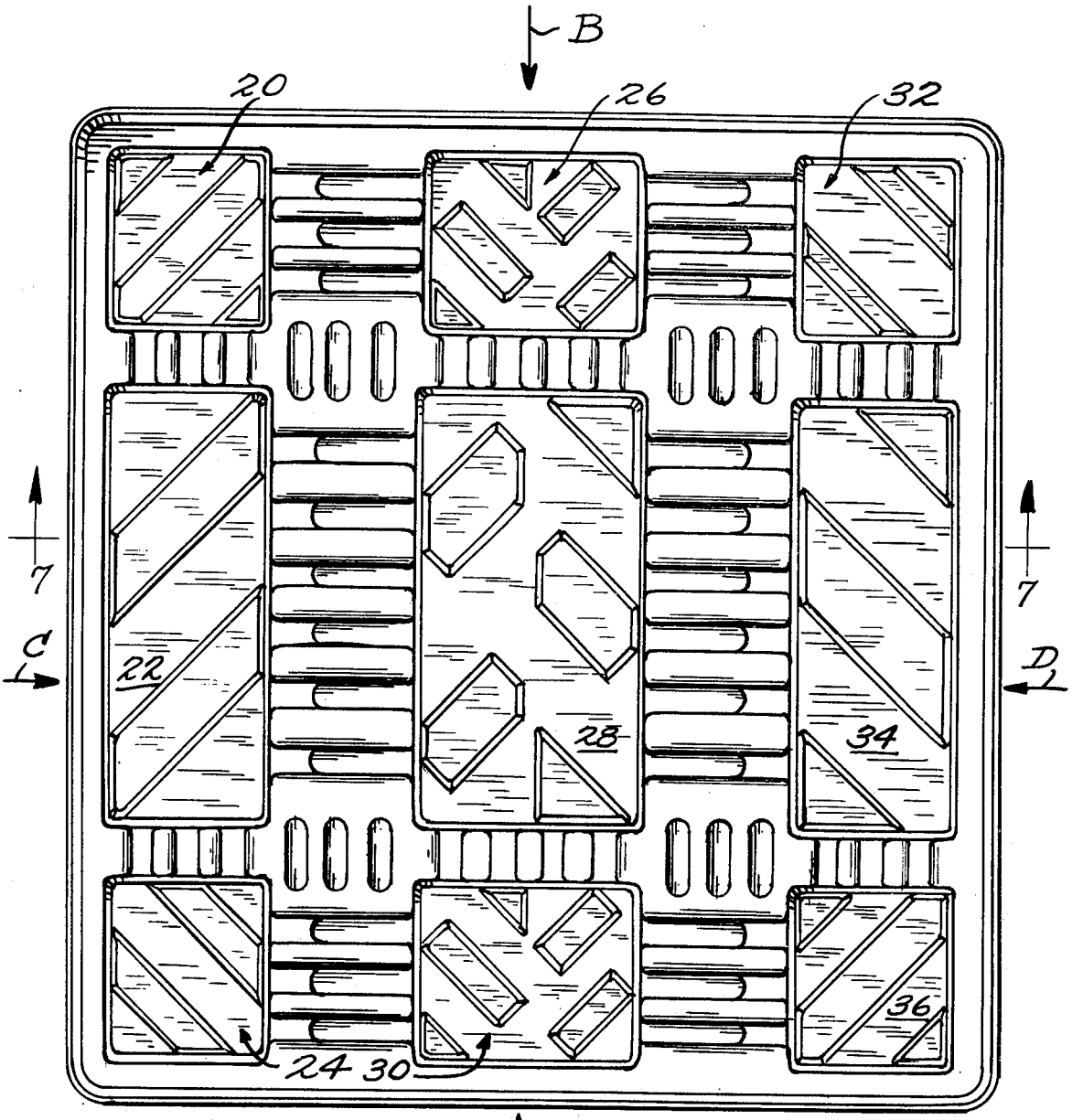
FIG. 2 is a top or concave view of the pallet shown in FIG. 1.
Figure 3:
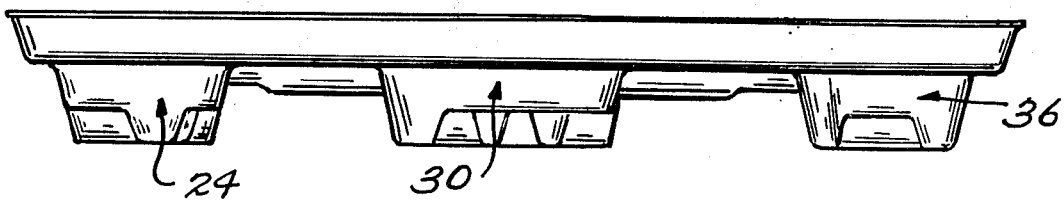
FIG. 3 is a side view of the pallet of FIG. 2 viewed from arrow A.
Figure 4:
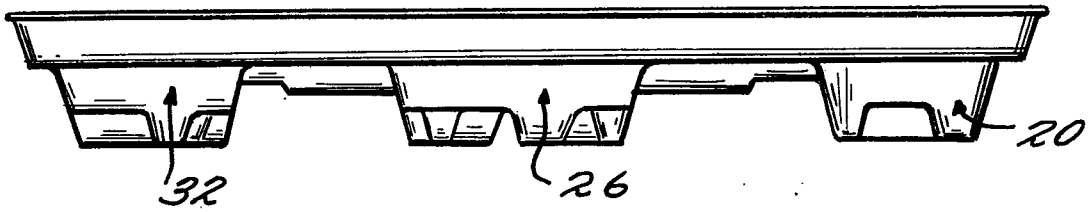
FIG. 4 is a plan view of one side indicated by arrow B in FIG. 2.
Figure 5:
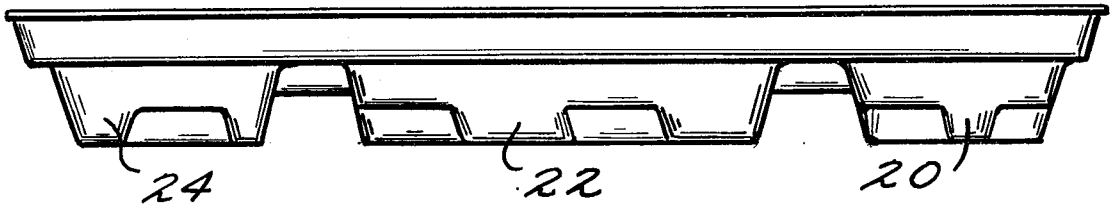
FIG. 5 is a plan view of one side of the pallet indicated by arrow C in FIG. 2.
Figure 6:
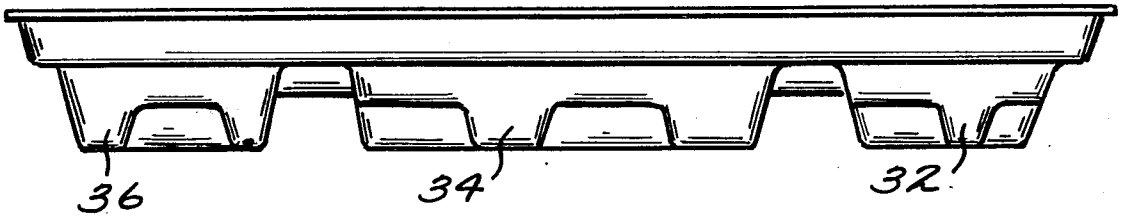
FIG. 6 is a plan view of one side of the pallet indicated by arrow D in FIG. 2.

Referring to FIG. 1, there is shown a bottom view of a shipping pallet 10. Deck area 12 is generally planar and rib structures 14, 16 and 18 and ribbed foot portions 20, 22, 24, 26, 28, 30, 32, 34 and 36 depend therefrom. Each of said foot portions comprises a plurality of reinforcing, interlockable male and female rib sections, illustrated for the case of foot 34, by male ribs 38, 40 and 42, and female ribs 44 and 46. Each of said foot portions have such male and female rib members. Rib structures 14 provide the supporting surface for the lifting of the pallet by the fork of a lift truck within lift channels 48 and 50. While only two such fork lift truck entry channels have been shown, it should be understood that an additional set of channels perpendicular to channels 48 and 50 could be provided so that four-way entry for the fork of a lift truck would be possible.

Within channels 48 and 50 are additional channels 52 and 54 respectively, which are formed from ribs 16 which are a separate portion within ribs 14 and have surfaces which are recessed from the surfaces of ribs 14. These additional channels, 52 and 54, are provided for purposes of protecting strapping used to retain the palletized shipping container, especially when the fork of a lift truck engages ribs 14 during lifting.

Adjacent channels 48 and 50 are the aforesaid foot portions.

Figure 10:
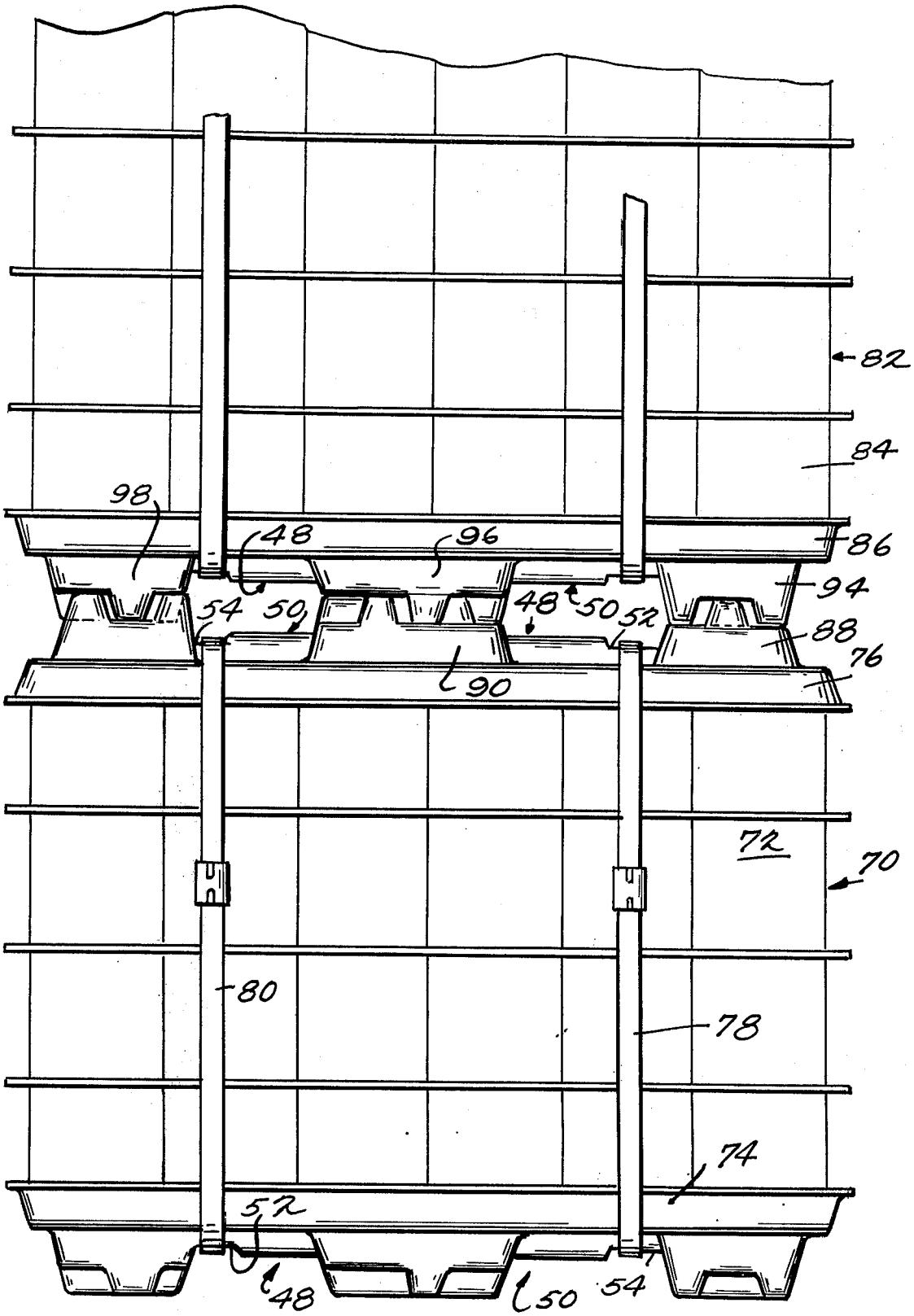
FIG. 10 is a side view of the side of two palletized stacked shipping containers showing one complete container and a bottom portion of a second container stacked thereon.
Figure 11:
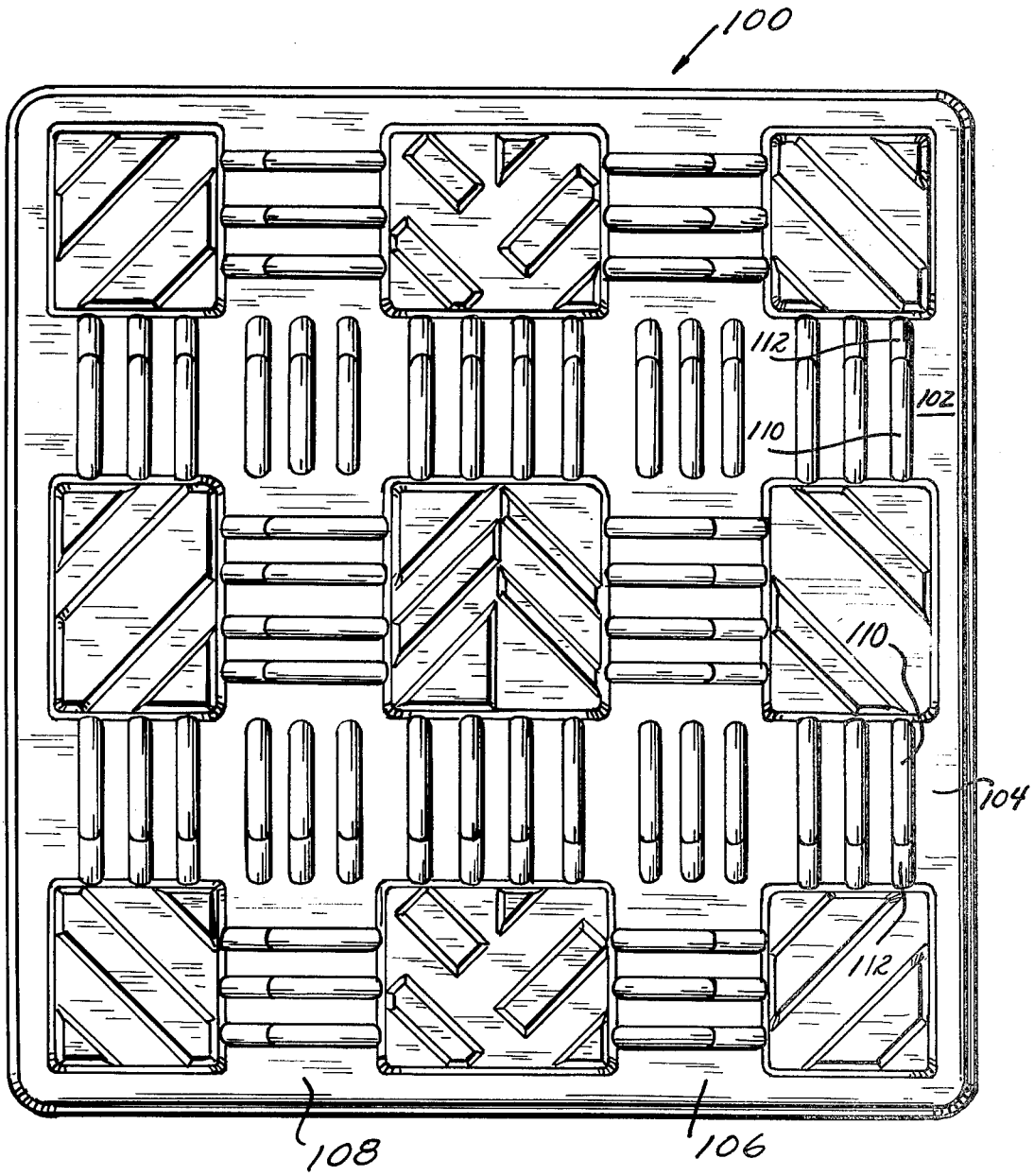
FIG. 11 is a bottom view of the pallet of the invention having four-way fork truck entry channels.
Figure 12:
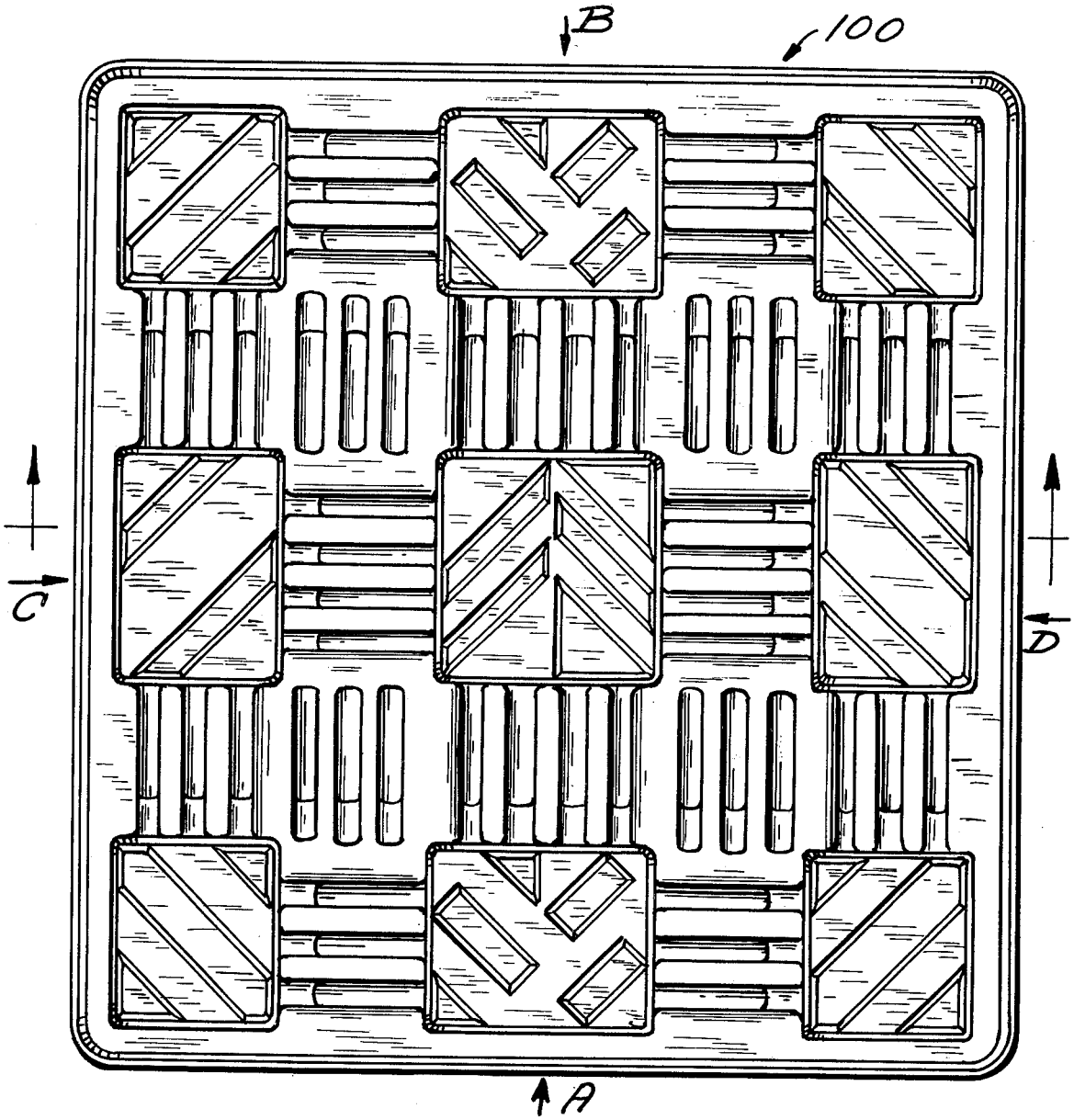
FIG. 12 is a top view of the pallet of FIG. 11.
Figure 17:
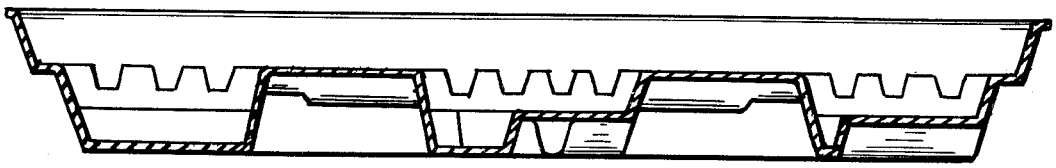
FIG. 17 is a cross-sectional view of the pallet of FIG. 11 taken along line 17—17.
Figure 13:
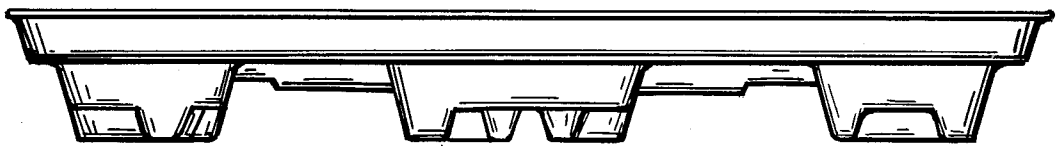
FIG. 13 is a side view of one side of the pallet of FIG. 12 viewed from arrow E.
Figure 14:
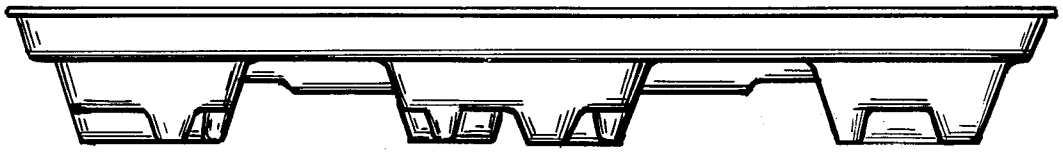
FIG. 14 is a plan view of one side of the pallet of FIG. 12 viewed from arrow F.
Figure 15:
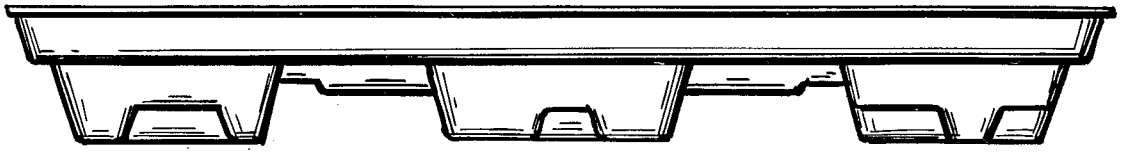
FIG. 15 is a plan view of one side of the pallet of FIG. 12 viewed from arrow G.
Figure 16:
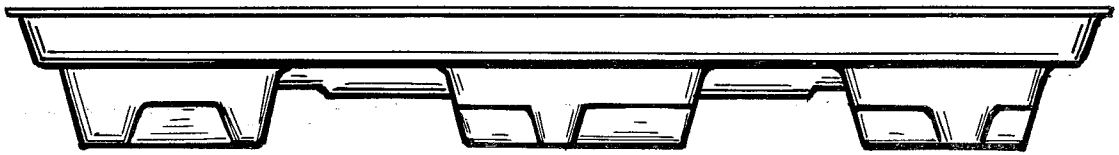
FIG. 16 is a plan view of one side of the pallet of FIG. 12 viewed from arrow H.

The staggered male and female rib design provides the primary reinforcing or supporting strength for the foot portions, and also, as shown in FIG. 10, provides the necessary interlocking elements of the foot portions of two pallets oriented in a stacked configuration.

Figure 7:
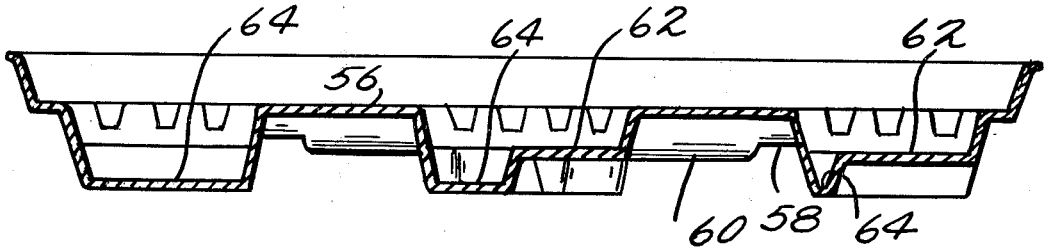
FIG. 7 is a cross-sectional view of the pallet of FIG. 2 taken along line 7—7.

As can be seen in the cross-sectional view of FIG. 7, there are approximately five levels of ribs in pallet 10; level 56 being the planar deck surface; level 58 being the top of the ribs forming strap channels 52 and 54 respectively; level 60 being the top of the ribs forming the lift support surface in fork lift channels 48 and 50; level 62 being the upper surface of female members in each of the respective foot portions; and, level 64 being the bottom of the pallet or bottom of the male portions in each of the respective foot portions.

Figure 8:
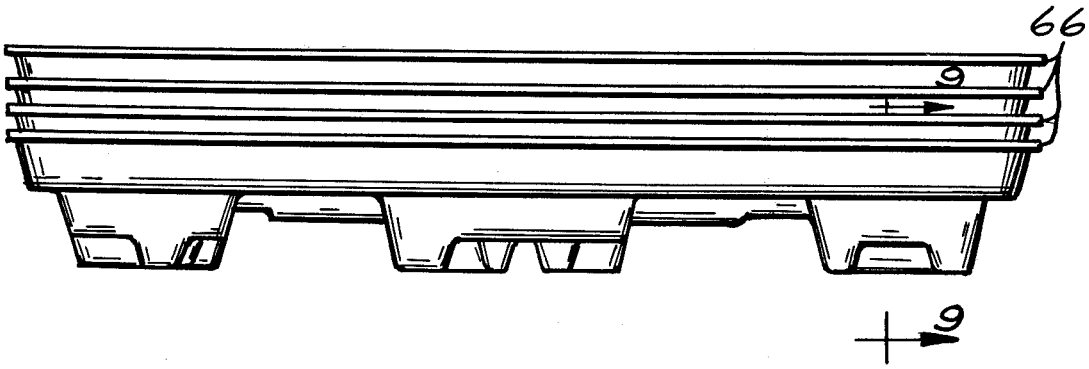
FIG. 8 is a side view of four nested pallets of FIG. 1 with the side shown being that of FIG. 3.
Figure 9:
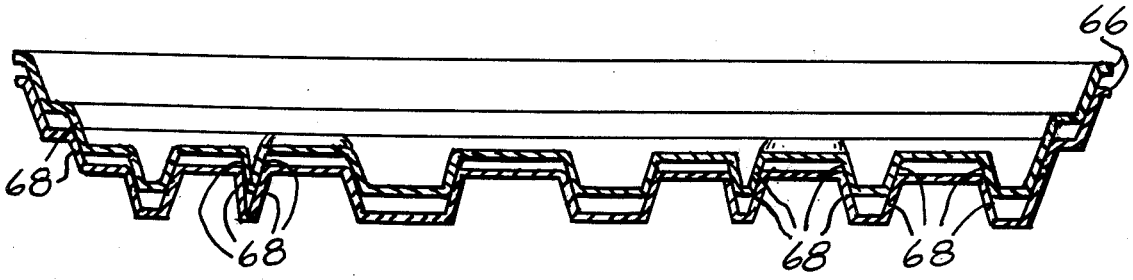
FIG. 9 is a cross-sectional view of two of the nested pallets of FIG. 8 taken along line 9—9.

FIG. 8 shows four pallets nested together. The preferred degree of nesting or fitting together is shown best in FIG. 9 which is a cross-sectional view taken along line 9—9 of FIG. 8 of two of the nested trays. It can be seen that when nested to this degree, flange 66 provides a convenient handhold for placing trays in a nested condition and for removing trays a nested condition. Also, FIG. 9 shows each of the wall areas 68 in the pallet tapered so as to permit reception of a complementary wall area on an adjacent pallet.

The reinforcing rib members 14, 16 and 18 respectively are positioned substantially symmetrically from center line CL as are the various foot portions. While the preferred reinforcing rib member arrangement is shown, other rib or groove arrangments can be designed that would provide nesting and interlocking features for the foot portions of shipping pallets. It is greatly preferred that the male and female ribs of said foot portions have walls which are tapered only enough to provide adequate nesting characteristics.

As previously stated, shipping trays are preferably made from a single sheet of formable material and in practicing this invention, it has been found that a 48 by 44-inch tray with foot portions formed as shown will provide sufficient strength and stability to support a load in excess of 20,000 lbs. The supporting surfaces of the feet 20, 22, 24, 26, 28, 30, 32, 34 and 36, when in the stacked orientation, preferably have an average area of about 300 to about 450 square inches. Likewise, with foot portions arranged as shown, the tray is capable of traveling on any type of conveyor system without the need for any specific leading edge orientation. This particular foot portion configuration has been found to be applicable to both roller and chain type conveyors without suffering any loss of stability regardless of the pallet's orientation. It is, however, essential that when placed on a conveyor system, the conveying system have continuous contact with a sufficient portion of the supporting surfaces of the pallet during conveyor travel so that the pallet is supported substantially uniformly during that travel. The particular configuration of the male and female ribs of the pallet feet as shown herein have been found to provide these required support characteristics.

In order to best describe how to arrange the pallets in a stacked configuration, reference is made to FIG. 10. FIG. 10 shows a shipping container 70 which comprises a load 72, a bottom shipping tray 74, and an upper shipping tray 76. Trays 74 and 76 are of identical design as are illustrated in FIGS. 1–9 hereof. The upper shipping tray 76 and the lower shipping tray 74 are banded together by means of fastening straps 78 and 80, located in channels 52 and 54 respectively. While fastening straps 78 and 80 would be sufficient to hold the shipping container 50 together, in some instances it has been found desirable to place a shrink-wrap film (not shown) around the entire container 70 so as to better protect the load from becoming soiled during shipping.

As shown in FIG. 10, another shipping container 82 comprised of a load 84, a bottom pallet 86 and a top pallet (not shown) has been placed on top of shipping container 70. Pallets 76 and 86 are oriented in a stacked configuration, with the bottom or covex surface of pallet 76 resting adjacent the bottom or convex surface of pallet 86. Channel 50 of pallet 76 is adjacent channel 48 of pallet 86. Channel 50 of pallet 76 is adjacent channel 48 of pallet 86 and channel 48 of pallet 76 is adjacent channel 50 of pallet 86 so as to provide for entry of the fork of a lift truck. Likewise, the foot portions of pallets 76 and 86 are arranged one over the other. Foot portions 88, 90 and 92 of pallet 76 fit into mating foot portions 94, 96 and 98, respectively, of pallet 86 and become interlocked through the complementary male and female ribs. Feet 88 and 98 correspond to foot 24 of FIG. 1, feet 90 and 96 correspond to foot 30 of FIG. 1, and feet 92 and 94 correspond to foot 36 of FIG. 1. A similar interlocking will likewise occur with the other mating foot portions of both pallets. Such interlocking between foot portions of pallets 76 and 86 provides a positive control over lateral shifting of one pallet or container with respect to the other, while employing the pallet's feet as the primary support elements in the stacked arrangement. Thus a very stable platform for stacking purposes is provided and yet sufficient clearance is retained for the entry of the fork of a lift truck into the openings formed by channels 48 and 50. It has been found that the interlocking design as described herein allows for the stacking of four to five shipping containers, one on top of another, in a very stable stack.

It is generally preferable to include one or more weepholes in the shipping pallet to allow air circulation through the pallet thereby to reduce or prevent mildew, and also to assist in the separation of nested pallets, by preventing the formation of a partial vacuum during separation.

FIGS. 11–17 represent a similar pallet 100, with the figures corresponding to those of FIGS. 1, 2, 7 and 3–6, respectively, wherein the pallet has channels 102, 104, 106 and 108 permitting four-way entry of the forks of a lift truck. The structure of pallet 100 is the same as that of pallet 10 of FIGS. 1–7 except the size of feet 22, 28 and 34 have been reduced to provide channels 102 and 104. The ribs 110 in channels 102 and 104 have recessed areas 112 located thereon for strapping purposes. Otherwise, the corresponding parts of pallet 100 are the same as is pallet 10.

Although the preferred form of this invention has been shown and described hereinabove, it is to be understood that this description is by way of illustration and not limitation. Therefore, it is not intended to limit the scope of the invention by the embodiment selected for the purpose of this disclosure but only by the claims which follow.

What is claimed is:

1. A shipping pallet for transporting a load secured thereto and formed from a single sheet of deformable material, comprising a generally planar deck having an upwardly extending exterior wall portion, said wall portion being adapted to locate said load and act as means for gripping said pallet, a network of reinforcing rib members entending away from said deck, a first portion of said reinforcing rib members defining at least two channels within said pallet adapted to permit entry of the forks of a lift truck under said pallet, a plurality of foot means extending away from said first portion for supporting said pallet, each of said foot means having complimentary supporting surfaces formed from a second portion of reinforcing rib members comprising a plurality of alternating male and female sections within each of said foot means, wherein said supporting surfaces are formed into an interlocking herringbone pattern substantially across the entire area of said surfaces, said male and female sections being located in planes other than the plane of said deck, said male sections providing support for said pallet when not in a stacked orientation, said male and female sections being adapted to interlock with foot means of an inverted similarly designed pallet when said similarly designed pallet and said pallet are placed in a stacked orientation whereby the mating surfaces of the male and female sections of said pallet and said inverted similarly designed pallet provide substantially the sole supporting surfaces between the stacked pallets and prevent lateral shifting of said pallet with respect to said similarly designed pallet when in that stacked orientation.

2. A shipping pallet as in claim 1 wherein said foot means are symmetrically located within said pallet.

3. A shipping pallet as in claim 1 wherein said wall and reinforcing rib members are adapted to permit the nesting of one pallet within another.

4. A shipping container for securing and transporting a load, said container comprising identical top and bottom shipping pallets and strapping means for securing the top and bottom pallets to said load wherein each said top and bottom pallet comprises a generally planar deck having an upwardly extending exterior wall portion, said wall portion being adapted to locate said load, a network of reinforcing rib members extending away from said deck, a first portion of said reinforcing rib members defining at least two channels within said pallet adapted to permit entry of the forks of a lift truck under said pallet, a plurality of foot means extending away from said first portion for supporting said pallet, each of said foot means having complimentary suporting surfaces formed from a second portion of reinforcing rib members comprising a plurality of alternating male and female sections within each said foot means, wherein said supporting surfaces are formed into an interlocking herringbone pattern substantially across the entire area of said surfaces, said male and female sections being located in planes other than the plane of said deck, said male sections in said bottom pallet providing support for said container when not in a stacked orientation, said male and female sections of said top pallet being adapted to interlock with complimentary foot means of an inverted similarly designed pallet comprising the bottom pallet of a second container when the second container is placed in a stacked orientation on the first container whereby the mating surfaces of the male and female sections provide substantially the sole supporting surfaces between the containers and prevent lateral shifting of the containers when in that stacked orientation.

* * * * *